US008353241B1

(12) United States Patent
Manney, III et al.

(10) Patent No.: US 8,353,241 B1
(45) Date of Patent: Jan. 15, 2013

(54) HYDRAULIC CYLINDER CUSHION

(75) Inventors: Charles J. Manney, III, Hamburg, NY (US); William J. Anderson, Williamsville, NY (US); Eric A. Stanczyk, Gasport, NY (US)

(73) Assignee: HDM Hydraulics, LLC, Tonawanda, NY (US)

( * ) Notice: Subject to any disclaimer, the term of this patent is extended or adjusted under 35 U.S.C. 154(b) by 645 days.

(21) Appl. No.: 12/626,735

(22) Filed: Nov. 27, 2009

Related U.S. Application Data

(60) Provisional application No. 61/200,263, filed on Nov. 26, 2008.

(51) Int. Cl.
*F15B 15/22* (2006.01)

(52) U.S. Cl. ..... 92/85 B; 91/396; 91/405

(58) Field of Classification Search ..... 91/394, 91/395, 396, 404, 405; 92/85 B
See application file for complete search history.

(56) References Cited

U.S. PATENT DOCUMENTS

| | | | |
|---|---|---|---|
| 2,755,775 | A | 7/1956 | Flick et al. |
| 3,247,767 | A | 4/1966 | Aslan |
| 4,064,788 | A | 12/1977 | Rich et al. |
| 4,352,318 | A | 10/1982 | Kolchinsky et al. |
| 4,386,555 | A | 6/1983 | Horiuchi et al. |
| 4,424,737 | A | 1/1984 | Endo |
| 5,125,325 | A | 6/1992 | Czukkermann |
| 5,193,431 | A | 3/1993 | Propsting et al. |
| 6,386,088 | B1 | 5/2002 | Yoshimoto et al. |

FOREIGN PATENT DOCUMENTS

| | | |
|---|---|---|
| JP | 55033954 | 3/1980 |

*Primary Examiner* — Michael Leslie
(74) *Attorney, Agent, or Firm* — Simpson & Simpson, PLLC

(57) ABSTRACT

A hydraulic cylinder cushion including a cylinder having a longitudinal axis and an inner chamber, a piston rod having a base, a cushion spear having a spear base, a shaft extending from the spear base, and a spearhead arranged opposite the spear base, the spearhead comprising a hemispherical portion connected to the shaft, wherein the hemispherical portion is diametrically larger than the shaft, and an end cap having a bore, wherein the end cap is secured to a first end of the cylinder such that the bore faces the inner chamber and is substantially aligned with the longitudinal axis, the piston rod is slidingly arranged within the inner chamber along the longitudinal axis such that the base faces the end cap, the cushion spear is pivotably secured to the base of the piston rod and extends toward the bore, and the bore is adapted to receive the cushion spear therein.

13 Claims, 5 Drawing Sheets

HYDRAULIC CYLINDER CUSHION

CROSS-REFERENCE TO RELATED APPLICATIONS

This application claims the benefit under 35 U.S.C. §119 (e) of U.S. Provisional Application No. 61/200,263 filed on Nov. 26, 2008 which application is incorporated herein by reference in its entirety.

FIELD OF THE INVENTION

The invention broadly relates to hydraulic cylinder cushions and, more particularly, to spear-type hydraulic cylinder cushions.

BACKGROUND OF THE INVENTION

Spear-type hydraulic cylinder cushions are well known devices for decelerating piston rods and dampening their impact with end caps of hydraulic cylinders. Generally such cushions comprise a spear-like structure attached to the end of a piston rod and adapted to enter a bore in an end-cap. Upon entry into the bore, fluid restriction is increased, thereby decelerating the piston rod.

However, many hydraulic cylinders, such as those utilized in snow plows, experience various loads which cause the piston rod to shift radially, i.e., out of axial alignment, within the cylinder. Accordingly, the efficacy of spear-type cushions is reduced when this occurs, as the spear-like structure also becomes axially misaligned and cannot properly enter the bore in the end cap, which may also cause galling.

Thus, there is a long-felt need for a hydraulic cylinder cushion which can be axially realigned when the piston rod to which it is attached is axially misaligned.

BRIEF SUMMARY OF THE INVENTION

Broadly, the subject invention is a hydraulic cylinder cushion comprising: a cylinder having a longitudinal axis and an inner chamber; a piston rod having a base; a cushion spear having a spear base, a shaft extending from the spear base, and a spearhead arranged opposite the spear base, the spearhead comprising a substantially hemispherical portion connected to the shaft, wherein the hemispherical portion is diametrically larger than the shaft, i.e., the radial cross-section of the shaft is smaller than that of the spear base and the spearhead; and, an end cap having a bore and a fluid port, the bore and the fluid port being in fluid communication, wherein the end cap is secured to a first end of the cylinder such that the bore faces the inner chamber and is substantially aligned with the longitudinal axis, the piston rod is slidingly arranged within the inner chamber along the longitudinal axis such that the base faces the end cap, the cushion spear is pivotably secured to the base of the piston rod and extends toward the bore, and the bore is adapted to receive the cushion spear therein.

The cushion spear is preferably adapted to pivot toward the longitudinal axis when the piston rod is radially shifted relative to the longitudinal axis, and the spearhead and bore define an annular gap when the spearhead enters the bore, thereby generating a back pressure which decelerates the movement of the piston rod, which may occur even before the radial alignment of the piston rod is corrected by the spear entering the bore. Thus, it is important the radial cross-section of the shaft is smaller than that of the spearhead, so that the spearhead has enough clearance past the edge of the bore's entrance to partially penetrate the bore and generate the annular gap. In addition, the spearhead may include a frustoconical tip to help guide the spearhead into the bore when the piston rod is radially shifted relative to the longitudinal axis.

In one embodiment, the piston rod includes a counter-bore arranged in the base and adapted to receive the spear base, and a collar arranged to secure the spear base within the counter-bore. The counter-bore and the collar may be threadingly engageable, so that a user may easily remove the cushion spear from the base, i.e., the counter-bore may be internally threaded and arranged to threadingly engage an externally threaded collar. The collar includes an aperture through which the shaft extends, and the counter-bore, collar, and aperture are arranged such that the cushion spear is able to shift radially and/or pivot in and out of alignment with the longitudinal axis of the piston rod.

In one embodiment, the bore is tapered, the spearhead and bore define an annular gap when the spearhead enters the bore, and the annular gap becomes progressively smaller when the cushion spear is pushed into the bore. As the annular gap becomes progressively smaller, the back pressure in the inner chamber of the cylinder increases, thereby increasing the deceleration of the piston rod.

In one aspect of the invention, the spherical design of the tip of sphere is arranged to provide a substantially constant clearance between the tip and the bore when the sphere enters the cushion, regardless of the position of the spear. In another aspect of the invention, the tapering of the bore (shank) may be modified, positively and/or negatively taper, thus a structural arrangement for a progressive cushion effect. Additionally, the tolerance of the radial movement of the stem is preferably adjustable. In yet another aspect of the present invention, the spear and cushion comprise dissimilar materials in order to prevent galling.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Figure 1:
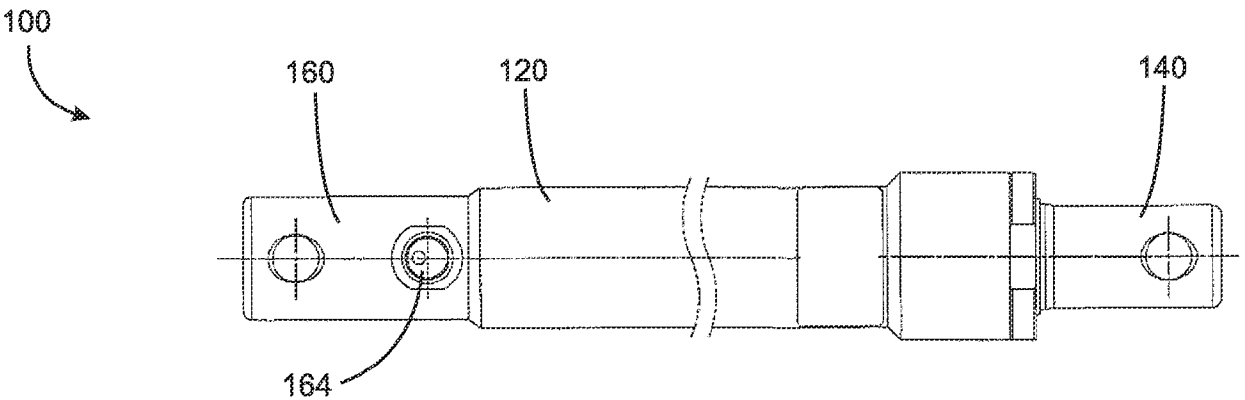
FIG. 1 is a top, plan view of the present invention hydraulic cylinder cushion.
Figure 2:
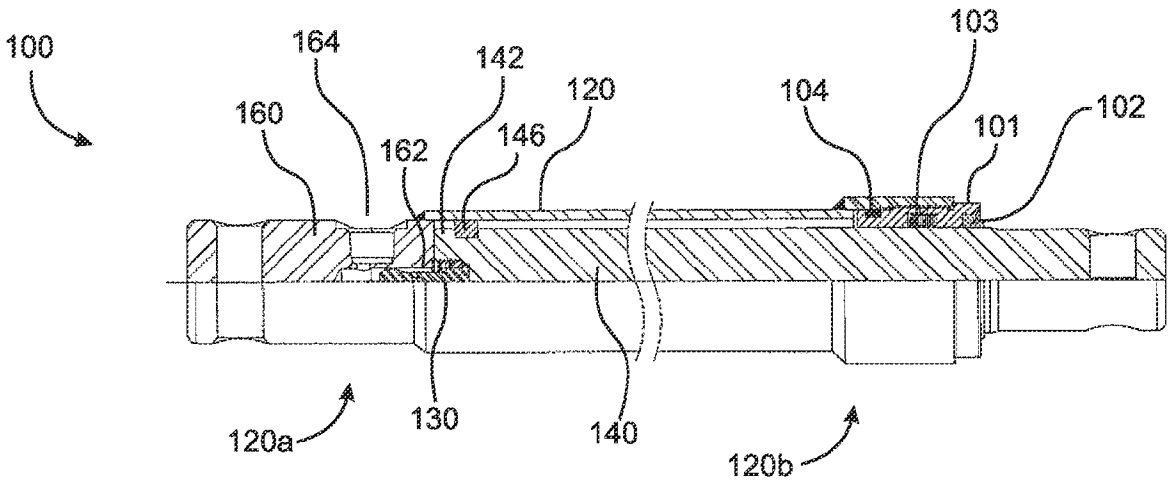
FIG. 2 is a right side elevational and partial vertical cross-sectional view taken generally along axis A-A' shown in FIG. 1.
Figure 5:
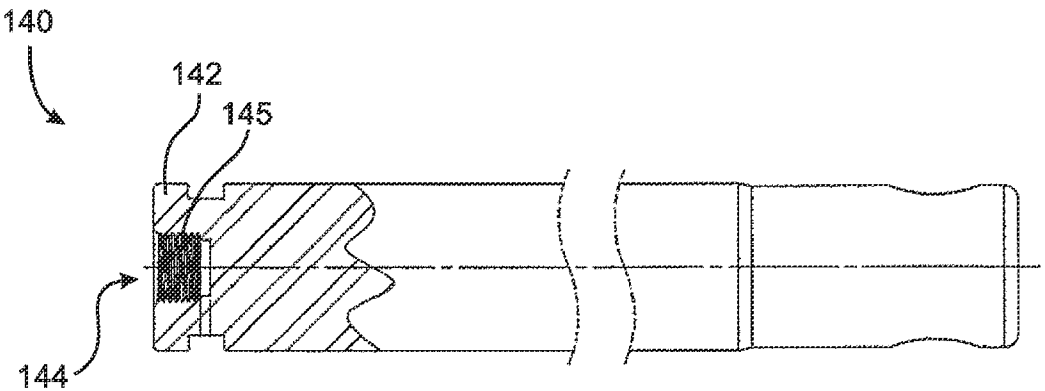
FIG. 5 is a right side elevational and partial vertical cross-sectional view taken generally along axis B-B' shown in FIG. 4.
Figure 7:
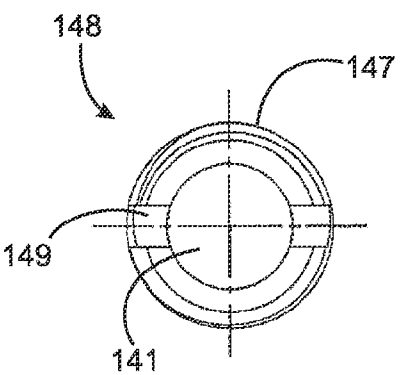
FIG. 7 is front elevational view of the collar.
Figure 9:
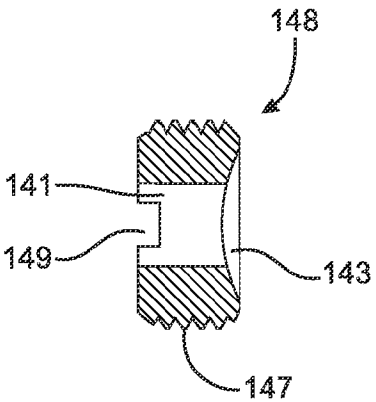
FIG. 9 is a vertical cross-sectional view of the collar.
Figure 6:
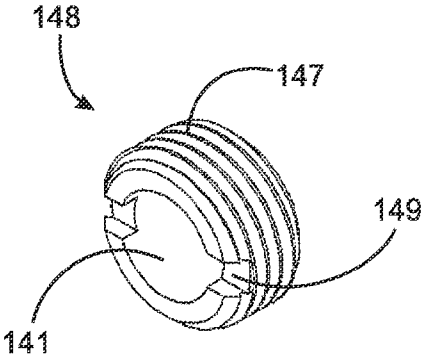
FIG. 6 is a perspective view of the collar.
Figure 8:
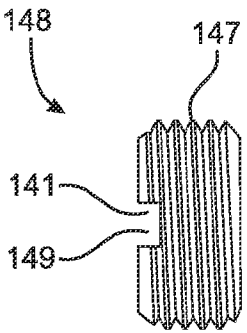
FIG. 8 is a right side elevational view of the collar.
Figure 10:
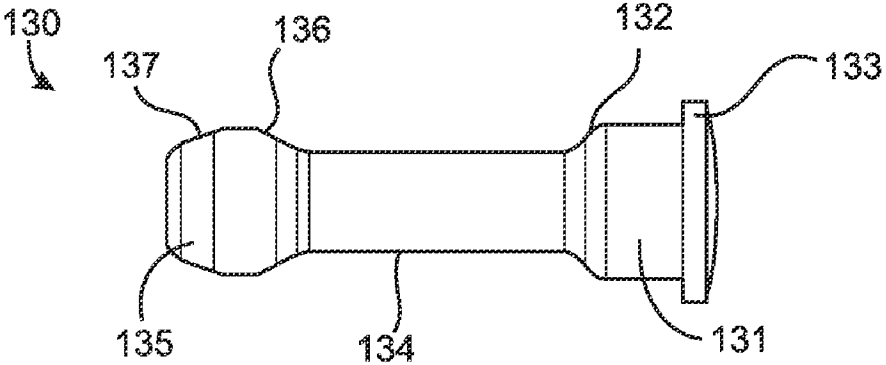
FIG. 10 is a right side elevational view of the cushion spear.

The following description of is best understood in view of FIGS. 1 and 2. These figures show hydraulic cylinder cushion 100, hereinafter referred to as cushion 100, which broadly comprises cylinder 120, piston rod 140, and cushion spear 130, and end cap 160. FIG. 1 is a top view of cylinder 120, piston rod 140, and cushion spear 130, and end cap 160 assembled as cushion 100. FIG. 2 is a right side view and partial vertical cross-section of cushion 100 taken generally along central, longitudinal axis A-A' of cylinder 120. As shown in FIGS. 5, 9, and 10, respectively, piston rod 140 includes central longitudinal axis B-B', cushion spear 130 includes central longitudinal axis C-C', and end cap 160 includes central longitudinal axis D-D'. When cylinder 120, piston rod 140, and cushion spear 130, and end cap 160 are assembled as cushion 100, axes A-A', B-B', C-C', and D-D' are substantially aligned. However, as described above, particular loads applied to the hydraulic cylinder can cause axis B-B' of piston rod 140 to be forced out of alignment with axis A-A' of cylinder 120. As described in detail below, cushion 100 is designed to operate as an effective hydraulic cylinder cushion even under such circumstances.

Cylinder 120 may be any type of cylinder typically used for the body assembly of hydraulic cylinders. In one embodiment, cylinder 120 comprises a hollow, metal tube having first end 120*a* opposite second end 120*b* and defining inner cavity 122. As stated above, cylinder 120 includes central, longitudinal axis A-A'. Cylinder 120 may include rod gland 101 secured to second end 120*b* and having wiper 102, rod seal 103, O-ring 104, the structure and function of which are well known in the art and need not be repeated here. Moreover, it is well known in the art that hydraulic cylinders are filled with hydraulic fluid, such as fluid 105, wherein such fluid may enter and exit the cylinder through the end cap.

Piston rod 140 may be any type of rod typically used for hydraulic cylinders. As shown in FIGS. 4-9, piston rod 140 is preferably substantially cylindrical, generally comprises base 142, and may include ring seal 146. Piston rod 140 is adapted to slide back and forth within inner cavity 122 along axis A-A'. As stated above, when cylinder 120 and piston rod 140 are assembled together, axes A-A' and B-B' are substantially aligned. As described in further detail below, base 142 is adapted to be pivotably coupled to cushion spear 130. For example, piston rod 140 may include counter-bore 144, which may have threads 145, and collar 148, which may have threads 147 adapted to threadingly engage threads 145, such that collar 148 may be screwed into counter-bore 144. However, it is well known in the art that piston rods commonly include a piston threaded onto the base of the rod, in which case, counter-bore 144 should be arranged on the piston. Collar 148 includes through-bore 141, and may include slot 149 for screwing it into the counter-bore. As shown in FIG. 9, collar 148 may also include recessed inner back surface 143, the function of which is described in further detail below.

Figure 11:
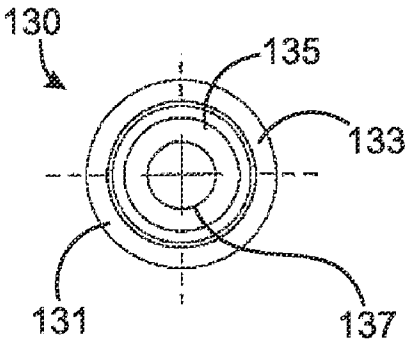
FIG. 11 is a front elevational view of the cushion spear.

As shown in FIGS. 10 and 11, cushion spear 130 comprises spear base 131, shaft 134 extending from spear base 131, and spearhead 135 arranged opposite spear base 131. Spearhead 135 comprises substantially hemispherical portion 136 connected to shaft 134. For reasons described in further detail below, substantially hemispherical portion 136 is diametrically larger than the shaft 134. In a preferred embodiment, spearhead 135 includes frustoconical tip 137. Spear base 131 may comprise shoulder 132 diametrically larger than the shaft 134, but potentially equal to spearhead 135, and flange 133, and convex base surface 139.

The present invention cushion spear and piston rod are adapted to be pivotably secured to each other. For example, in the embodiment shown in the figures, counter-bore 144 is adapted to receive spear base 131 therein, and collar 148 is adapted to slide over spearhead 135 and shaft 134, such that shaft 134 extends through through-bore 141. Flange 133 is diametrically larger than through-bore 141, so that once it is screwed into counter-bore 144, collar 148 secures spear base 131 therein. Additionally, recessed inner back surface 143 of collar 148 is provided to allow convex back surface 139 to rock against counter-bore 144. Therefore, since through-bore 141 is necessarily wider than shaft 134, once secured within counter-bore 144 with collar 148, cushion spear 130 is pivotably connected to base 142. However, it should be appreciated that the embodiment shown in the figures is simply an exemplary embodiment and other pivotable connections are possible and within the scope and spirit of the present invention. For example, the spear base and piston rod base may comprise a ball and socket joint, which would allow the cushion spear to pivot relative to the piston rod. In addition, the collar need not be threaded, and may be a snap ring arranged around the spear base and adapted to snap into the counter-bore.

When cushion spear 135 is pivotably secured to base 142 its axis C-C' is substantially aligned with axis B-B' of piston rod 140. However, this pivotable connection allows cushion spear 130 to pivot toward axis A-A' and D-D' when the piston rod is axially misaligned with the cylinder and the bore of the end cap. Thus, as base 142 of piston rod 140 moves toward end cap 160, even when axially misaligned, spearhead 135 can pivot toward A-A' and D-D' and enter bore 162 before realignment and without galling the edge of bore 162. As stated above, spearhead 135 preferably includes frustoconical tip 137, which helps guide spearhead past the edge of bore 162 and into axial alignment with axes A-A' and D-D'.

Figure 3:
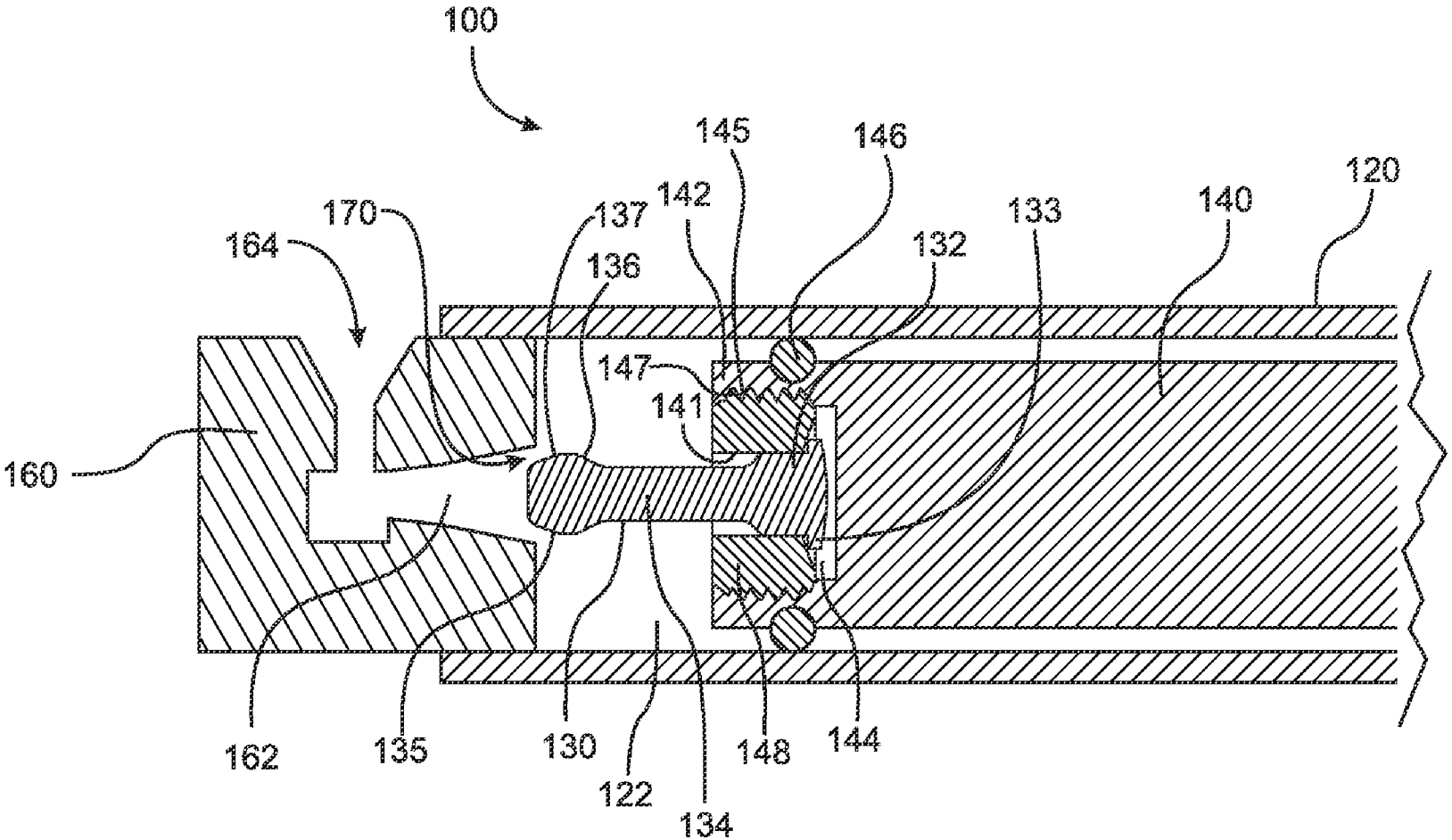
FIG. 3 is a schematic, vertical cross-sectional view taken generally along axis A-A', showing the piston rod moving toward the end cap of the hydraulic cylinder cushion.
Figure 4:
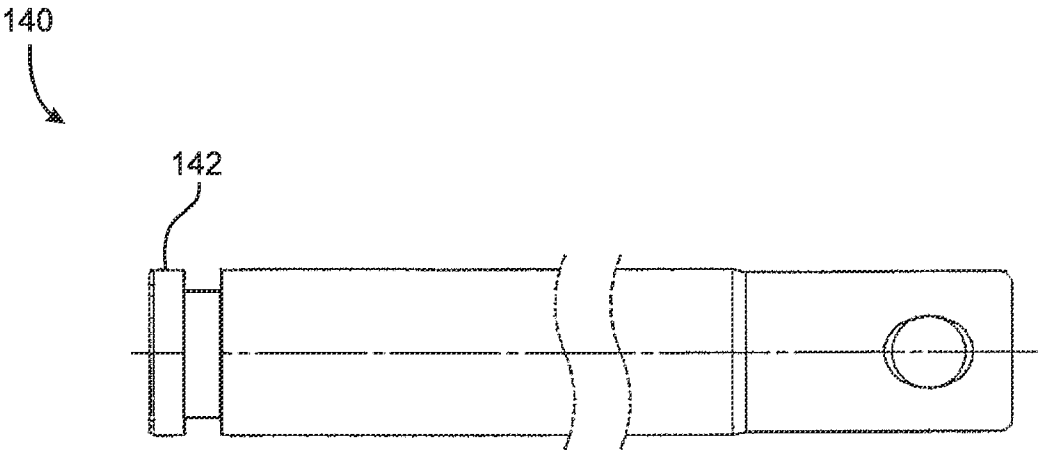
FIG. 4 is top plan view of the piston rod.
Figure 13:
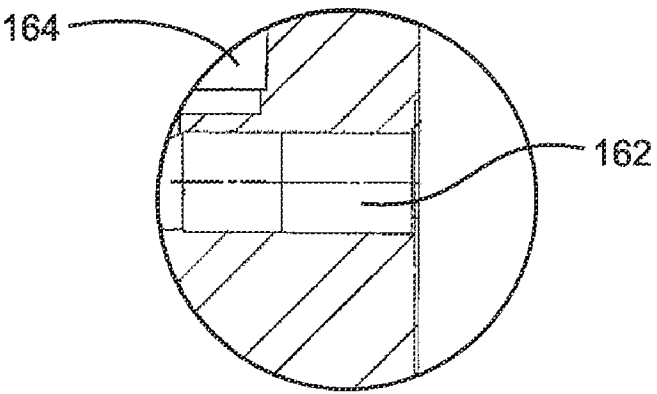
FIG. 13 is an enlarged view of Area 13 shown in FIG. 12.
Figure 12:
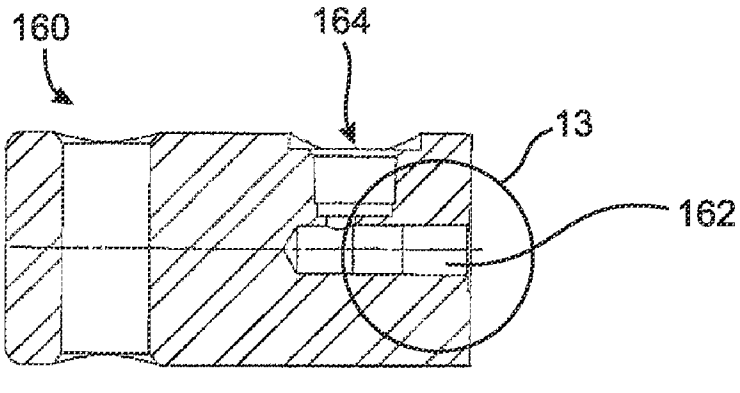
FIG. 12 is a vertical cross-sectional view of the end cap taken generally along axis D-D'.

As shown in FIGS. 12 and 13, end cap 160 generally comprises bore 162 and fluid port 164, wherein the bore and the fluid port are in fluid communication with each other. End cap 160 is secured to first end 120*a* of cylinder 120 such that bore 162 faces inner chamber 122. End cap 160 includes longitudinal axis D-D', along which bore 162 is arranged. As shown in FIGS. 12 and 13, bore 162 may be substantially cylindrical. However, as shown in FIG. 3, bore 162 may include a negatively tapered section, i.e., a section which is progressively radially smaller as it extends into the end cap. In addition, the finish of the bore may be smooth or may be textured in order to control its performance. For example, the bore may be rifled, which may improve the stability and accuracy of the flow of fluid.

Due to its substantially hemispherical shape, when spearhead 135 enters bore 162 it defines annular gap 170, which increases flow restriction of fluid 105, thereby decelerating piston rod 140. Thus, hemispherical portion 136 must be diametrically larger than shaft 134 so that spearhead 135 may enter bore 162 and define annular gap 137, as well as to mitigate galling the side of the cushion spear against the edge of the bore.

When bore 162 is tapered, as shown in FIG. 3, this annular gap becomes progressively smaller as the cushion spear is pushed down the bore. As the annular gap becomes progressively smaller, the fluid restriction increases, thereby further decelerating the piston rod. It should be appreciated that bore 162 may be tapered in any suitable way in order to control the acceleration/deceleration of the piston rod. For example, the bore may be positively or negatively tapered, or some combination of both.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What we claim is:

1. A hydraulic cylinder cushion comprising:

a cylinder having a longitudinal axis and an inner chamber;

a piston rod having a base;

a cushion spear having a spear base, a shaft extending from the spear base, and a spearhead arranged opposite the spear base, the spearhead comprising a substantially hemispherical portion connected to the shaft, wherein the hemispherical portion is diametrically larger than the shaft; and, an end cap having a bore and a fluid port, the bore and the fluid port being in fluid communication, wherein the end cap is secured to a first end of the cylinder such that the bore faces the inner chamber and is substantially aligned with the longitudinal axis, the piston rod is slidingly arranged within the inner chamber along the longitudinal axis such that the base faces the end cap, the cushion spear is pivotably secured to the piston rod and extends toward the bore, and the bore is adapted to receive the cushion spear therein.

2. The hydraulic cylinder cushion recited in claim 1 wherein the cushion spear is adapted to pivot toward the longitudinal axis when the piston rod is radially shifted relative to the longitudinal axis.

3. The hydraulic cylinder cushion recited in claim 1 wherein the spearhead and bore define an annular gap when the spearhead enters the bore.

4. The hydraulic cylinder cushion recited in claim 1 wherein the spearhead includes a frustoconical tip.

5. The hydraulic cylinder cushion recited in claim 1 wherein the piston rod includes a counter-bore arranged in the base and adapted to receive the spear base, and a collar arranged to secure the spear base within the counter-bore.

6. The hydraulic cylinder cushion recited in claim 5 wherein the counter-bore and the collar are threadingly engageable.

7. The hydraulic cylinder cushion recited in claim 1 wherein the bore is tapered.

8. The hydraulic cylinder cushion recited in claim 7 wherein the spearhead and bore define an annular gap when the spearhead enters the bore, and the annular gap becomes progressively smaller when the cushion spear is pushed into the bore.

9. The hydraulic cylinder cushion recited in claim 1 wherein the piston rod includes a piston attached to the base, and the cushion spear is pivotably connected to the piston.

10. A cushion spear having a spear base, a shaft extending from the spear base, and a spearhead arranged opposite the spear base, the spearhead comprising a substantially hemispherical portion connected to the shaft, wherein the hemispherical portion is diametrically larger than the shaft.

11. The cushion spear recited in claim 10 wherein the spearhead comprises a frustoconical tip.

12. The cushion spear recited in claim 10 wherein the spear base is diametrically larger than the shaft.

13. The cushion spear recited in claim 10 wherein the spear base includes a convex back surface.

* * * * *